US005365249A

United States Patent [19]

Benward

[11] Patent Number: 5,365,249

[45] Date of Patent: Nov. 15, 1994

[54] ELECTRONIC DISPLAY WITH HIGH SPATIAL RESOLUTION POINTER

[75] Inventor: Robert S. Benward, Huntington Station, N.Y.

[73] Assignee: Parker Hannifin Corporation, Cleveland, Ohio

[21] Appl. No.: 648,085

[22] Filed: Jan. 31, 1991

[51] Int. Cl.[5] ..... G09G 3/36

[52] U.S. Cl. ..... 345/50; 345/33; 368/242; 368/94

[58] Field of Search ..... 368/242, 84; 340/784, 340/785; 345/33, 38, 50, 87

[56] References Cited

U.S. PATENT DOCUMENTS

| | | | |
|---|---|---|---|
| 3,275,871 | 2/1964 | Yiotis | 368/242 |
| 4,242,747 | 12/1980 | Fahrenschon | 368/242 |
| 4,277,786 | 7/1981 | Waldron | 359/89 |
| 4,376,934 | 3/1983 | Prohaska et al. | 368/242 |
| 4,815,824 | 3/1989 | Sharples | 340/784 |

*Primary Examiner*—Ulysses Weldon

*Assistant Examiner*—Matthew Luu

*Attorney, Agent, or Firm*—Ralph E. Jocke

[57] ABSTRACT

An LCD display with a high resolution moveable pointer has a first image pane (10) with slanted conductive first segments (12) on a surface thereof. A second image pane (16) has second segments (18) and a surface thereof. The second segments are slanted opposite of the first segments. The LCD has the image panes mounted parallel to one another with the surfaces with the segments thereon facing one another with a dichroic liquid crystal material in between. A first set (26) of segments on the first image pane and a third set (30) of segments on the second pane are driven by first electrical signals of fixed amplitude and frequency. A second set of segments (28) on the first pane and a fourth set (32) on a second pane are driven by second signals 180° out of phase with the first signals. A pointer is formed at an area (38) where the dichroic material is subject to an electrical potential sufficient to make the dichroic material transparent. The pointer can be moved across the display in increments as small as the width of a segment.

1 Claim, 4 Drawing Sheets

ELECTRONIC DISPLAY WITH HIGH SPATIAL RESOLUTION POINTER

TECHNICAL FIELD

This invention relates to LCD displays. Particularly this invention relates to an LCD display with a high spatial resolution pointer.

BACKGROUND ART

LCD displays are well known in the prior art. Often such displays are used to produce alphanumeric characters. The most common types of LCD displays are the twisted nematic type which use a backplane and a disposed image plane with conductive segments etched thereon. Applying an electrical potential between the segments and the backplane forms an image of the segments in a liquid held between the backplane and the transparent plane.

LCD displays have been made to simulate dial or linear readouts, which are the common readouts for analog signals. Dial or linear displays are often preferable to numeric readouts because they provide an indication of a current condition in relation to an overall operating range. In addition, operators are accustomed to reading displays that include a moving pointer on the face of a linear, arcuate or circular scale.

A problem arises however when LCDs are used to simulate a moving pointer. The nature of conventional LCD displays has required a separate segment for each pointer position. As a result, it has not been possible to produce a display in which the pointer "moves" less than one pointer thickness. While the pointer can be made smaller so the pointer moves in smaller increments, as the pointer becomes smaller the display becomes more difficult to read.

Dot matrix type LCD displays can provide for movement of a simulated pointer less than a pointer width. The addressing scheme for a dot matrix LCD display is complex however. In addition, dichroic type LCD displays, which provide wide angle viewing desirable in many applications, cannot be addressed in dot matrix fashion.

Thus, there exists a need for a LCD display that produces a moveable pointer with high spatial resolution.

SUMMARY OF THE INVENTION

It is an object of the present invention to provide an LCD display that produces a moveable pointer with high spatial resolution.

It is a further object of the present invention to provide an LCD display which has a simplified addressing scheme.

It is a further object of the present invention to provide an LCD display with a moveable pointer than can be used in various configurations to simulate analog readouts such as a linear readout or a round dial.

It is a further object of the present invention to provide a display that can be used with any type of liquid crystal display construction.

Further objects of the present invention will be made apparent in the following Best Modes for Carrying Out Invention and the appended claims.

The foregoing objects are accomplished in an LCD display having a first pane with a plurality of first slanted rectangular conductive electrodes or first segments etched on a surface of the pane. The width of the first segments corresponds to the resolution while the height of the first segments corresponds to the height of the pointer to be produced by the LCD display. The angle of the first segments corresponds to the angle of a first side of the pointer that is produced.

A plurality of second slanted segments, similar in size to the first, are etched onto a surface of second pane in the LCD which is disposed parallel to the first pane. The second segments are slanted at a similar, but opposed angle to the first segments, and are similar in width and height.

A dichroic type liquid crystal material is held between the first and second panes. A dye is added to the dichroic material render the fluid opaque. When the superimposed areas of the panes are at a different electrical potential, the molecules of the liquid crystal and dye align perpendicular to the panes. This makes them transparent in the area where the potential is applied and opaque where no potential is applied.

The pointer is formed by applying a potential in the form of a continuously oscillating first square wave signal to a first set of first segments on the first pane. A second signal similar to the first, except 180 degrees out of phase with the first signal, is applied to a second set first segments.

The first signal is also applied to a third set of second segments on the second pane. The third set overlies the first set and in addition overlies the second set in an area in which the pointer is to be formed. The second signal is applied to a fourth set of second segments. The fourth set overlies the second set outside the area of the pointer.

In the area where the third set overlies the second set, the signals between the panes are out of phase. As a result, the electrical potential causes the dichroic liquid crystal material to become transparent in this area forming a triangular pointer. In the areas outside the pointer, the segments on the first and second pane are always at the same electrical potential so the area outside the pointer remains opaque.

The segments on the first and second panes that form the pointer in any particular position may be interconnected to simplify the addressing scheme for the segments. The same principles may be applied to form linear, dial, arcuate or other types of displays.

BEST MODES FOR CARRYING OUT INVENTION

Figure 1:
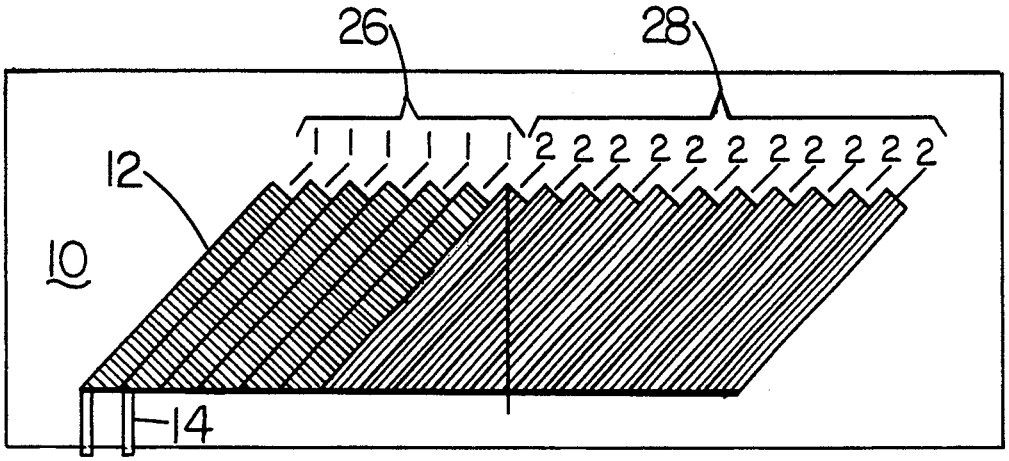
FIG. 1 is a plan view of a first image pane with first conductive segments thereon.

Referring now to the drawings and particularly to FIG. 1, there is shown therein a first image pane generally indicated 10. First pane 10 is comprised of a generally transparent glass material of the type commonly used in LCD displays. Etched on a surface first pane 10 are a plurality of conductive segments 12. First segments 12 are etched adjacent to each other on a surface of first pane 10 with each of said segments being electrically distinct from the adjacent segments. The segments in the preferred embodiment are made from a thin film of indium tin oxide (ITO). The film of ITO is sufficiently thin so that the segments are transparent. First tracks 14, only two of which are shown, are used to make electrical connections the first segments.

First segments 12 are slanted to the right as shown in FIG. 1.

The segments are all the same height and are of uniform width. The width of the segments is desirably small to achieve high spatial resolution and thereby a very small increment between the successive pointer positions formed by the display.

Figure 2:
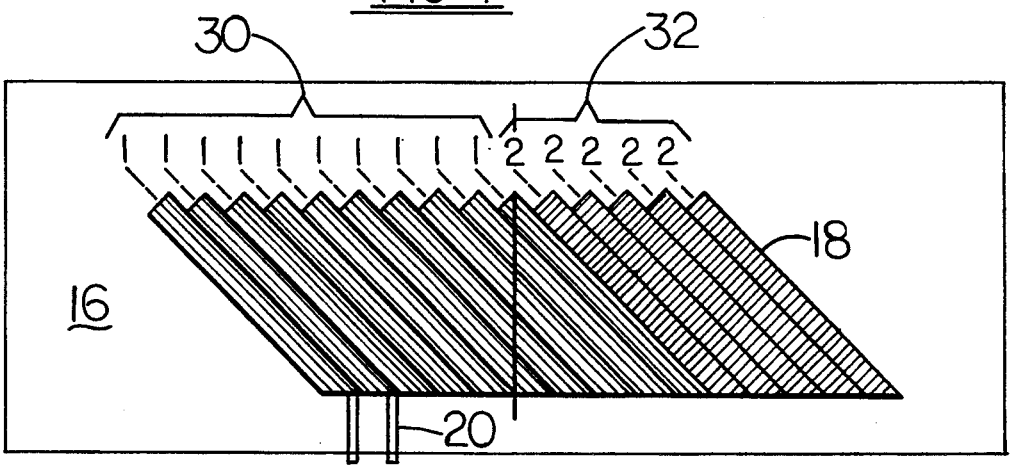
FIG. 2 is a plan view of a second image pane with second conductive segments thereon.

A second image pane 16 is shown in FIG. 2. Pane 16 is made of the same material as the first image pane. A plurality of second segments 18 of ITO material are etched thereon. The second segments are electrically connected through second tracks 20, only two of which are shown.

Figure 7:
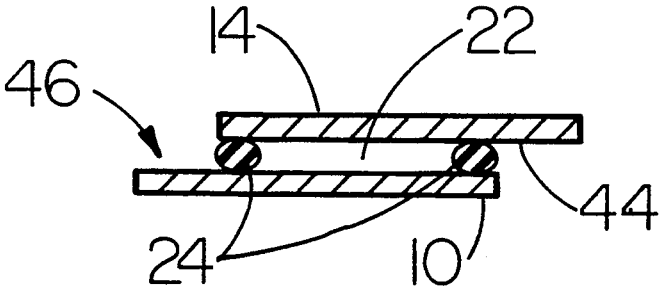
FIG. 7 is a side view of a display of the present invention with the first and second segments separately driven.

As shown in FIG. 7, when the LCD display of the present invention is assembled, second pane 14 is disposed over first pane 10 in parallel fashion to form a space 22 between the panes. A dichroic liquid crystal material is held space 22 by gaskets 24. The panes are oriented with the surfaces having the segments thereon facing toward the space. Viewed from the top of the LCD, the segments are in the "criss-cross" pattern shown in FIG. 3.

The dichroic liquid is of the type known in the prior art. The molecules of the dichroic material are long chains and many of the molecules lie parallel to the image panes of the LCD when there is no difference in electrical potential between the segments on the first and second panes. When the molecules are in this condition the material is generally opaque. If an electrical potential is applied between the panes, the molecules of the dichroic material align perpendicular to the panes in the area where an electrical potential is applied. As a result, the area in which the molecules of the dichroic materials are aligned becomes transparent. Dyes are added to the dichroic material to enhance the difference in opacity between the aligned and non-aligned conditions.

Referring again to FIG. 1, to produce a pointer, a first set 26 of first segments are driven electrically by a first signal. The first signal is a continuous square wave having a fixed frequency. The first set of segments is shown hatched and labelled with a "1" to show they are driven by the first signal.

A second set 28 of first segments are driven by a second electrical signal. The second signal is similar in amplitude and frequency to the first signal but is 180° out of phase therewith. First segments in the second set are shown hatched perpendicular to those in the first set and are labelled with a "2" to show that they are driven by the second signal.

Referring to FIG. 2, a third set 30 of second segments on the second image pane are driven by the first signal. A fourth set 32 of second segments are driven by the second signal.

Figure 3:
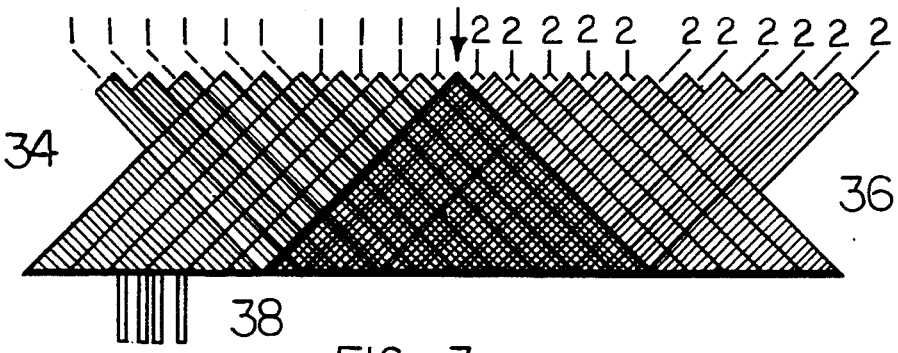
FIG. 3 is a plan view of a pointer formed by the LCD of the present invention.

FIG. 3 shows the result when the first and second panes are overlapped to form the LCD display of the present invention. In a first area 34 where first set 26 and third set 30 overlie each other, there is no electrical potential between the panes. This is because the first and third sets are both driven by the first electrical signal. As a result, the dichroic liquid is opaque in the first area.

In a second area 36 where the second set 28 and the fourth set 32 overlie one another, there is also no electrical potential between the panes. This is because the second set and the fourth set are both driven by the second electrical signal. The dichroic liquid is opaque in the second areas as a result.

A third area 38 is formed where the third set overlies the second set. An electrical potential exists between the panes in the third area because the first signals driving the third set is 180° out of phase with the second signals driving the second set. The electrical potential causes the liquid in the third area 38 to become transparent relative to the first and second areas. As a result, a pointer is formed which is wide at its base, but has a sharp, defined point. By controlling the segments supplied with the first and second signals, the pointer can be moved across the display in increments as small as the width of one segment.

The present invention provides a dramatic improvement over conventional LCD displays where the incremental movement of a pointer is limited to the pointer width. The present invention achieves a wide pointer that is moveable in very small increments. This provides for a very accurate display that is easy to read.

As shown in FIGS. 1–3, for the fixed size pointer of the preferred embodiment the segments connected to the first electrical signals on the first and second panes always have a fixed relationship. For example, the second segments on the second pane connected to the first signals extend to the right beyond the segments on the first pane connected to the first signals by the width of the pointer.

The same is true with respect to the segments connected to the second signals. The first segments driven by the second signals on the first pane extend to the left of second segments on the second pane driven by the second signals by the width of the pointer. Because the segment phases advance in unison, the segments on the first pane can be electrically connected to corresponding segments on the second pane to reduce the complexity of the electrical drivers required for the display.

Figure 4:
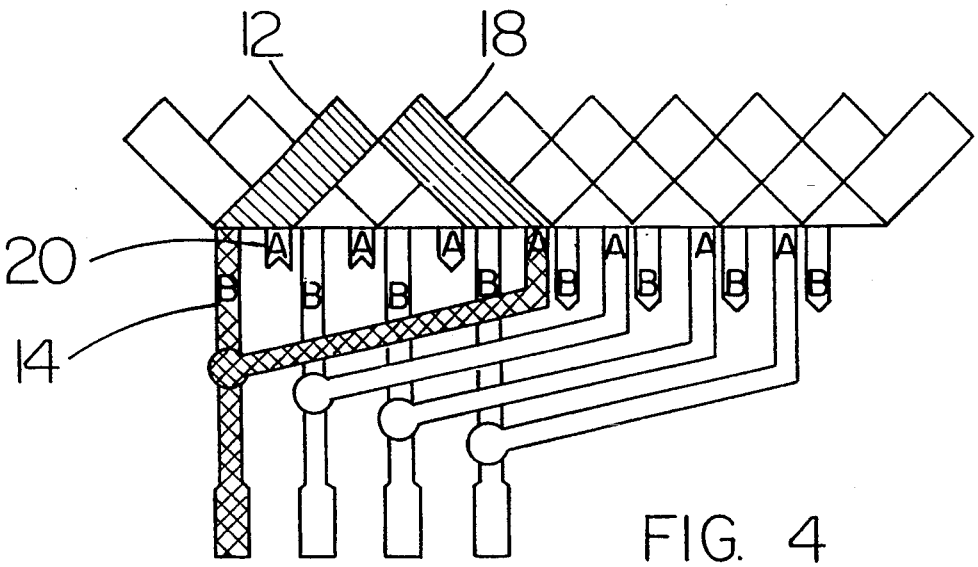
FIG. 4 is a plan view of a first embodiment of a linear display with the first and second segments interconnected.

As shown in FIG. 4, the tracks labelled "B" providing signals to each of first segments 12 on the first pane, is each electrically connected to a single second segment 18 on the second pane. To form the pointer in the area between the hatched segments, all the first tracks 14 to the left of the track hatched in FIG. 4 would be driven by the first signal. Further, all first tracks to the right of the hatched track would be driven by the second signal. As a result the addressing scheme for the tracks in greatly simplified.

Figure 5:
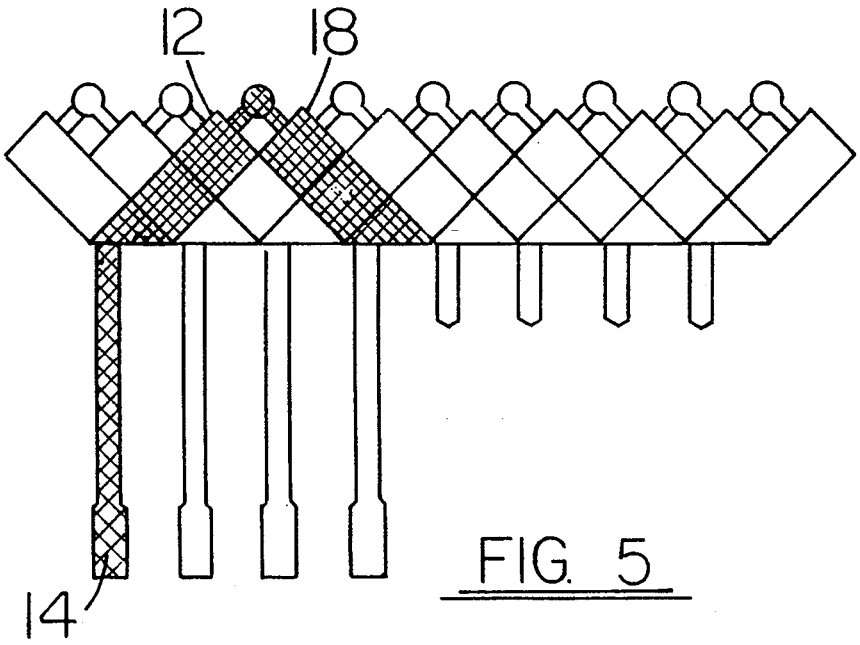
FIG. 5 is a plan view of a second embodiment of a linear display with the first and second segments interconnected.
Figure 6:
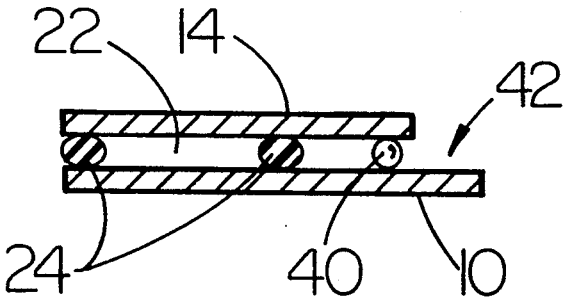
FIG. 6 is a side view of a display of the present invention with the first and second segments interconnected.

FIG. 5 shows an alternative configuration for interconnecting the first and second segments to achieve the same result as the embodiment shown in FIG. 4. In this embodiment the segments are connected by interconnect dots 40. As shown in FIG. 6, the panes 10, 16 can be extended beyond the gaskets 24 on the same side so all connections to the display originate at a single contact surface 42. This differs from the embodiment shown in FIG. 7 where the first and second segments are not interconnected, and two contact surfaces 44, 46 are required to drive the display.

Figure 8:
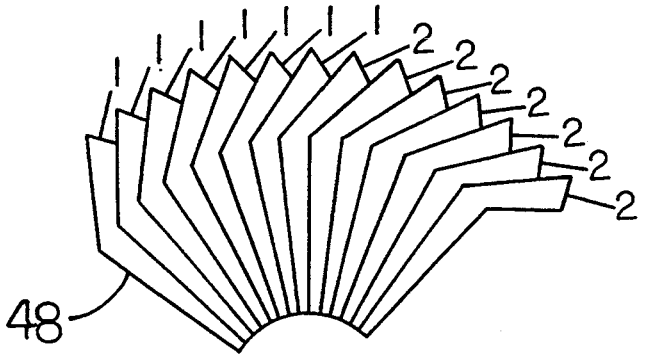
FIG. 8 is a plan view of a first image pane of a further alternative embodiment of the invention having a round dial configuration.
Figure 9:
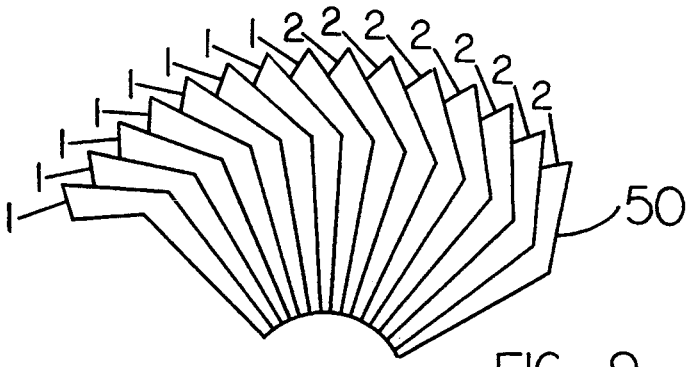
FIG. 9 is a plan view of a second image pane of the alternative embodiment of FIG. 8.
Figure 10:
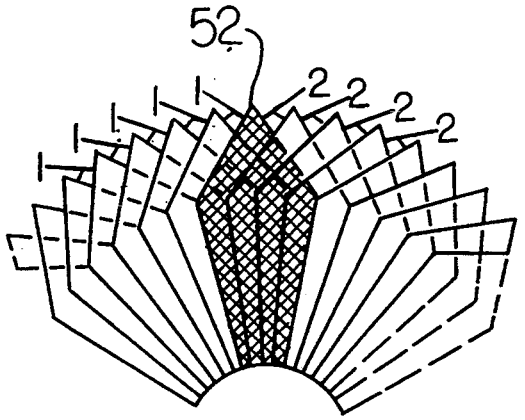
FIG. 10 is a plan view of the rotary dial pointer display including the first and second image panes of the alternative embodiment.

A further alternative embodiment of the invention is shown in FIGS. 8–10. This embodiment is a round dial type display. This embodiment is similar to the others except that first dogleg shaped segments 48 are formed on the surface of the first pane. Second dogleg segments 50 which are bent opposite of the first segments are formed on a surface of the second pane.

When the LCD is formed by disposing the panes with the dichroic material between the first and second segment and are driven by the first and second signals as indicated by "1" and "2". The pointer 52 is formed by the slanted edges of the segments in the area where the signals are out of phase. The pointer may be moves incrementally around the display in a manner similar to the linear display. In addition, in this embodiment, the related first and second segments may be interconnected to reduce the drivers needed for the display.

The principles of the present invention may be applied to many types of displays. These may include arcuate displays and 360° circular displays, in addition to the linear and dial displays disclosed herein. In addition, multiple panes in excess of 2 may be sandwiched or superimposed to form even more complex shapes. Additional panes can also be used to provide identical displays overlying each other to enable the displays to work with back lighting or a combination of back lighting and front lighting. In addition, the principles of this invention may be applied to displays other than dichroic LCDs, that use a material whose properties are altered by electric condition.

Thus, the electronic display with high spatial resolution pointer of the present invention achieves the above stated objectives; eliminates difficulties encountered in the use of prior system; solves problems and attains the desirable results described herein.

In the foregoing description, certain terms have been used for brevity, clarity and understanding, however, no unnecessary limitations are to be implied therefrom because such terms are used for descriptive purposes and are intended to be broadly construed. Moreover, the descriptions and illustrations given are by way of examples and the invention is not limited to the exact details shown or described.

Having described the features, discoveries and principles of the invention, the manner in which is utilized, and the advantages and useful results obtained; the new and useful structures, devices, elements, arrangements, parts, combinations, systems, equipment, operations, methods and relationships are set forth in the appended claims.

I claim:

1. A dial display having a radial pointer said pointer having an indicator having a width in a direction of movement, said indicator movable in radial increments less than said width, said dial display comprising:

a first image pane having a plurality of adjacent first conductive segments thereon, each first segment including a first radially extending portion and a first tip portion in connection therewith, said first tip portion bounded by a first edge slanted in a clockwise direction with respect of said dial display said first segments having a thickness in the direction of movement equal to an increment;

a second image pane disposed in a first direction of said first image pane, said second image pane having a plurality of adjacent conductive second segments thereof, each second segment including a second radially extending portion and a second tip portion in connection therewith, said second tip portion bounded by a second edge slanted in a counterclockwise direction with respect of said dial display, whereby a projection of a first edge underlying a second segment intersects the second edge thereof at an acute angle to form a point position of said indicator, and wherein said second segments have said thickness in the direction of movement;

liquid crystal material between said first and second image panes visually indicating a first electrical condition between first segments and overlying second segments;

means for producing said first electrical condition between selected first segments and overlying second segments whereby said liquid crystal material forms a radially movable pointer having said width and wherein said pointer is movable in increments of said thickness.

* * * * *